US009642399B2

(12) United States Patent
Baba et al.

(10) Patent No.: US 9,642,399 B2
(45) Date of Patent: May 9, 2017

(54) SUIT AND METHOD FOR MANUFACTURING SAME

(71) Applicant: THE JAPAN WOOL TEXTILE CO., LTD., Kobe-shi, Hyogo (JP)

(72) Inventors: Takeichiro Baba, Hyogo (JP); Hiroyuki Kondo, Aichi (JP); Norio Asakawa, Osaka (JP); Shuichi Tanaka, Osaka (JP)

(73) Assignee: The Japan Wool Textile Co., Ltd., Hyogo (JP)

( * ) Notice: Subject to any disclaimer, the term of this patent is extended or adjusted under 35 U.S.C. 154(b) by 439 days.

(21) Appl. No.: 14/241,376

(22) PCT Filed: Nov. 15, 2012

(86) PCT No.: PCT/JP2012/079681
§ 371 (c)(1),
(2) Date: Feb. 26, 2014

(87) PCT Pub. No.: WO2013/157162
PCT Pub. Date: Oct. 24, 2013

(65) Prior Publication Data

US 2014/0223633 A1 Aug. 14, 2014

(30) Foreign Application Priority Data

Apr. 19, 2012 (JP) ..... 2012-095747

(51) Int. Cl.
*A41D 1/14* (2006.01)
*A41D 1/02* (2006.01)
(Continued)

(52) U.S. Cl.
CPC ..... *A41D 1/02* (2013.01); *A41D 1/00* (2013.01); *A41D 1/06* (2013.01); *A41D 1/14* (2013.01);
(Continued)

(58) Field of Classification Search
CPC ... A41D 1/02; A41D 1/04; A41D 1/06; D10B 2501/01; D10B 2501/04
(Continued)

(56) References Cited

U.S. PATENT DOCUMENTS 6,076,187 A * 6/2000 Wallerstein ..... A41B 1/00 2/115
2008/0201819 A1* 8/2008 Wheater ..... A41D 31/00 2/78.3
(Continued)

FOREIGN PATENT DOCUMENTS

CN 1078516 A 11/1993
CN 2785388 Y 6/2006
(Continued)

*Primary Examiner* — Katherine Moran
(74) *Attorney, Agent, or Firm* — Hamre, Schumann, Mueller & Larson, P.C.

(57) ABSTRACT

A suit of the present invention is a two-piece suit (1) including a coat (2) and trousers (3) and/or a skirt that are made from a woven fabric containing animal hair fibers and/or synthetic fibers. The coat (2) stretches more in the weft direction than in the warp direction, and the trousers (3) and/or skirt stretch more in the warp direction than in the weft direction. A method for producing the suit includes: for upper and lower parts of the suit, dyeing yarns of the same quality by the same method and producing woven fabrics that are woven in the same structure; differentiating stretchability of the woven fabrics in warp and weft directions in tentering processing by a heat set in a final finish step, thereby producing a cloth for coat and a cloth for trousers and/or skirt; and cutting and sewing the cloths. Thus, it is possible to provide a suit imparted with a function of high mobility even though it is a two-piece suit, and a method for producing the same.

18 Claims, 3 Drawing Sheets

(51) Int. Cl.

| | |
|---|---|
| ***A41H 43/00*** | (2006.01) |
| ***A41D 31/00*** | (2006.01) |
| ***A41D 1/00*** | (2006.01) |
| ***D03D 1/00*** | (2006.01) |
| ***A41D 1/06*** | (2006.01) |

(52) U.S. Cl.
CPC ..... *A41D 31/00* (2013.01); *A41H 43/00* (2013.01); *D03D 1/00* (2013.01); *D10B 2211/02* (2013.01); *D10B 2501/04* (2013.01)

(58) Field of Classification Search
USPC ..... 2/69, 69.5, 78.3, 79, 93, 94, 102, 108, 2/115, 227, 243.1, 244
See application file for complete search history.

(56) References Cited

U.S. PATENT DOCUMENTS

2011/0231986 A1* 9/2011 Waldie ..... A41D 13/0015 2/456
2013/0101781 A1* 4/2013 Lee ..... D02G 3/36 428/91
2014/0075640 A1* 3/2014 Carson ..... A41D 1/02 2/69

FOREIGN PATENT DOCUMENTS

| | | | |
|---|---|---|---|
| CN | 1920159 | A | 2/2007 |
| FR | 2331295 | | 6/1977 |
| JP | H02-025521 | U | 2/1990 |
| JP | 2002-155467 | | 5/2002 |
| JP | 2002-317348 | | 10/2002 |
| JP | 2006-257632 | | 9/2006 |
| JP | 3134796 | U | 8/2007 |
| JP | 2007-231437 | | 9/2007 |
| JP | 2008-274505 | | 11/2008 |
| JP | 2009-001951 | | 1/2009 |
| JP | 2009-235655 | | 10/2009 |
| JP | 3163375 | U | 10/2010 |

* cited by examiner

SUIT AND METHOD FOR MANUFACTURING SAME

TECHNICAL FIELD

The present invention relates to a two-piece suit composed of a coat and trousers and/or a skirt that are different in the stretch direction and stretchability, and a method for producing the same.

BACKGROUND ART

Generally, suits are two-piece garments composed of a coat and trousers and/or a skirt that are produced from the same cloth. Suits called setup suits or coordinated suits are garments that have different designs for the upper and lower parts and that can be combined freely with other garments. They sometimes are made from the same cloth and sometimes are made from different cloths. Among such suits, suits produced from the same cloth are a set of garments, the upper and lower parts of which have the same colored pattern and hence are formal. However, since their upper and lower parts have the same stretchability, it cannot be said that they have high mobility. On the other hand, suits whose upper and lower parts are produced from different cloths can be combined freely so as to obtain superior stretchability and high mobility. However, since their upper and lower parts have different colored patterns, it cannot be said that they are suitable for formal occasions.

As conventional proposals, Patent Documents 1 and 2 have proposed the combined use of wool and polyester filament yarns so as to impart stretchability. Patent Document 3 has proposed the use of core-spun yarns, which are obtained by winding wool around surfaces of elastomer fibers such as polyurethane, so as to impart stretchability. Patent Document 4 has proposed the treatment of wool with ethylenediamine so as to impart stretchability.

However, the methods proposed by Patent Documents 1-4 described above lack ingenuity for the stretch direction that matches the movement of a human body, and further improvements have been demanded.

PRIOR ART DOCUMENTS

Patent Documents

[Patent Document 1] JP 2009-235655 A
[Patent Document 2] JP 2006-257632 A
[Patent Document 3] JP 2009-001951 A
[Patent Document 4] JP 2008-274505 A

DISCLOSURE OF INVENTION

Problem to be Solved by the Invention

The present invention improves the above-described conventional problem, and provides a suit imparted with a function of high mobility even though it is a two-piece suit, and a method for producing the same.

Means for Solving Problem

A suit of the present invention is a two-piece suit including a coat and trousers and/or a skirt that are made from a woven fabric containing animal hair fibers and/or synthetic fibers. The coat stretches more in the weft direction than in the warp direction, and the trousers and/or skirt stretch more in the warp direction than in the weft direction.

A method for producing the suit of the present invention includes: for upper and lower parts of the suit, dyeing yarns of the same quality by the same method and producing woven fabrics that are woven in the same structure; differentiating stretchability of the woven fabrics in warp and weft directions in tentering processing by a drier or tentering processing by a heat set in a final finish step, thereby producing a cloth for coat and a cloth for trousers and/or skirt, respectively; cutting the cloth for coat and the cloth for trousers and/or skirt so that the coat stretches more in the weft direction than in the warp direction, and the trousers and/or skirt stretch more in the warp direction than in the weft direction; and sewing the cut cloths, thereby tailoring a suit.

Effect of the Invention

In the present invention, the coat stretches more in the weft direction than in the warp direction, and the trousers and/or skirt stretch more in the warp direction than in the weft direction, whereby they have stretchability that follows the movement of a human body. Thus, it is possible to provide a suit that is imparted with a function of high mobility even though it is a two-piece suit, and a method for producing the same.

DESCRIPTION OF THE INVENTION

Figure 1:
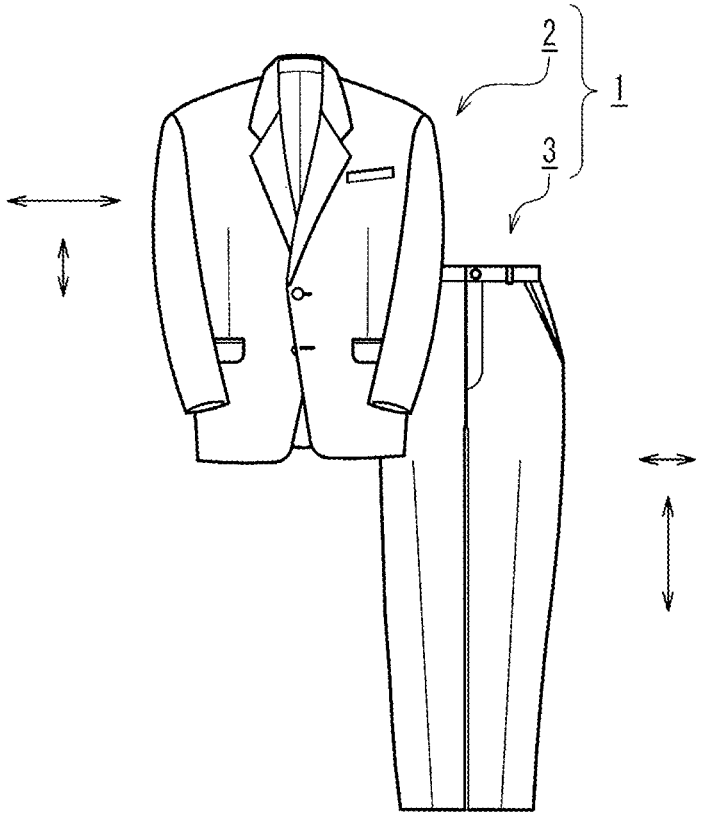
FIG. 1 is a front view of a man's suit in one embodiment of the present invention.

The inventors of the present invention have accomplished the present invention based on the following finding. In view of the movement of a human body when wearing a suit, in accordance with the motion of crossing arms and extending an arm, the coat with high stretchablity in the weft direction provides high mobility, whereas, in accordance with the motion of standing up and sitting down, the trousers and/or skirt with high stretchability in the warp direction provides high mobility.

The suit of the present invention is made from a woven fabric containing animal hair fibers and/or synthetic fibers. The animal hair fibers are typified by wool, and examples of the animal hair fibers include lamb wool, cashmere, mohair, alpaca, camel, and angora. The synthetic fibers are typified by polyester fibers, and examples of the synthetic fibers include nylon fibers and acrylic-based fibers. The fiber configuration is preferably 70% or more wool, and more preferably 100% wool. In the case of adding another fiber, the amount should be minimized to a role as a decorative yarn, or the like. By doing so, a woven fabric with the highest quality can be obtained.

The suit of the present invention is a two-piece suit including a coat and trousers and/or a skirt (hereinafter, also referred to as "upper and lower parts" simply). The suit essentially is composed of a coat and trousers, or a coat and a skirt. In the case of including a vest, the vest is configured to have the same configuration as the coat. The coat stretches more in the weft direction than in the warp direction, and the trousers and/or skirt stretch more in the warp direction than in the weft direction. By doing so, it is possible to obtain a two-piece suit that has stretchability following the movement of a human body and that is imparted with a function of high mobility. In the present invention, the coat also is called "jacket". The trousers also are called "pants". The lady's trousers also are called "pantaloons".

Regarding woven fabrics constituting the upper and lower parts of the suit, preferably the fiber material and the woven fabric structure (including woven pattern) are the same, the color is the same when they are patternless, and the pattern is the same when they are fabrics of colored pattern. Here, "same" refers to woven fabrics substantially identical, specifically, woven fabrics that are not obviously different from each other visibly. More specifically, regarding the color, a delta (Δ) E measured by a colorimeter is preferably 1 or less, and more preferably 0.5 or less. Regarding the pitch of a stripe pattern, etc., which is one of colored patterns, the pitch of the pattern of the trousers or skirt is preferably 0.9 to 1.1 times the pitch of the pattern of the coat. The reason for this is as follows: in the final stage of the production method described later, at the time of performing tentering processing, the upper and lower parts are separately subjected to the tentering processing so as to change the stretchability in the warp and weft directions, and hence may be different from each other in color and pattern slightly.

The woven fabric to be used for the suit of the present invention preferably is a yarn-dyed product. The yarn-dyed product is obtained by cotton dyeing (also called top dyeing) or yarn dyeing. By using the yarn-dyed product, patterns such as a stripe pattern can be expressed and color shift between rolls of cloth can be avoided. Further, in the case of cotton dyeing, colors are expressed using a plurality of colored cottons, which provides a woven fabric of high quality. Meanwhile, a patternless woven fabric may be a product of after dyeing (also called piece dyeing or cloth dyeing), which is dyeing after production of a woven fabric.

The woven fabric to be used for the suit of the present invention may have any known woven fabric structure such as twill weave, plain weave, and sateen weave. Among these, the plain weave structure or 2/1 and 2/2 twill weave structures are preferred because they are high grade.

As to the stretchability (JX) in the weft direction of the coat, the stretch rate under a load of 500 gf/cm is preferably 10 to 16%, and more preferably 12 to 14%. As to the stretchability (JY) in the warp direction of the coat, the stretch rate under a load of 500 gf/cm is preferably 2 to 8%, and more preferably 4 to 6%.

As to the stretchability (PX) in the weft direction of the trousers and/or skirt, the stretch rate under a load of 500 gf/cm is preferably 3 to 10%, and more preferably 4 to 6%. As to the stretchability (PY) in the warp direction of the trousers and/or skirt, the stretch rate under a load of 500 gf/cm is preferably 8 to 14%, and more preferably 10 to 12%. Preferably PX<PY is satisfied.

A woven fabric cloth to be used for the suit of the present invention preferably does not contain elastic synthetic fibers such as polyurethane fibers. The inclusion of elastic synthetic fibers such as polyurethane fibers tends to decrease the grade of wool woven fabrics.

In the method for producing the suit of the present invention, a cloth for coat and a cloth for trousers and/or skirt are produced separately by differentiating the stretchability in the warp and weft directions in tentering processing by a drier or tentering processing by a heat set in a final finish step. Specifically, in the tentering processing by a heat set in the final finish step, if a cloth is pulled in the weft direction (width direction), the stretchability in the warp direction increases. If a cloth is relaxed, the stretchability decreases. Further, the stretchability in the longitudinal direction increases with the raise of an overfeed rate, and decreases with the reduction of the overfeed rate. The same can be said about the warp direction (length direction). Thus, by differentiating the stretchability in the warp and weft directions, the respective cloths are produced. A tenter may perform the tentering processing. Further, a woven fabric before the final finish step preferably has stretchability both in longitudinal and transverse directions. As to the method for producing the woven fabric stretchable both in the longitudinal and transverse directions, preferably it includes a reduction treatment when containing 70% or more of animal hair fibers, and it includes a technique using high shrinkage yarns such as water-soluble vinylon, polyethylene terephthalate, and polybutylene terephthalate when containing 30% or more of synthetic fibers. However, the present invention is not limited to these methods.

The temperature of the tentering processing is preferably 100° C. to 150° C., and more preferably 110° C. to 130° C. The time for the tentering processing is preferably 1 to 10 minutes, and more preferably 3 to 8 minutes. The above-described ranges can fix the fabric thermally, with the stretchablity being differentiated in the warp and weft directions. Thus, the dimensional stability is maintained. The fabric is not deformed by temperatures comparable with the temperature of ironing after being tailored into a suit.

Next, the obtained fabrics are cut so that the coat stretches more in the weft direction than in the warp direction, and the trousers and/or skirt stretch more in the warp direction than in the weft direction. The cutting may be performed by an automatic cutter using a computer, or by scissors or a cutter one by one. The fabrics after cutting are sewn and tailored into suits in accordance with general techniques.

The stretchability of the suit of the present invention is measured by KES testing. The KES testing is proposed by Professor Sueo Kawabata of Kyoto University, based on an objective assessment regarding hand of garment cloth defined by "Hand Evaluation and Standardization Committee" formed in the Textile Mechinery Society of Japan, and performed using "KES-FB2-AUTO-A" (product name) manufactured by KATO TECH Co., Ltd. Having the stretchability EM of 10% or more in this evaluation is surprising for the woven fabric not containing spandex fibers. If the stretchability is high as described above, the fabric does not limit the movement of a human body when being tailored into a suit, thereby bringing comfortability.

The suit of the present invention is suitable as suits for individual use and a uniform, etc., to be worn as work clothes in companies, public offices, and the like, and as formal wear for policemen, self-defense personnel, firemen to be used for formal occasions.

Next, the present invention will be described with reference to the drawings. FIG. 1 is a front view of a man's suit in one example of the present invention. A man's suit 1 is a two-piece suit composed of a coat 2 and trousers 3, which are made from the same fiber material and the same woven fabric structure, and have the same colored pattern. The coat 2 stretches more in the weft direction than in the warp direction, and the trousers 3 stretch more in the warp direction than in the weft direction. The arrows indicate the stretchability in the warp and weft directions.

Figure 2:
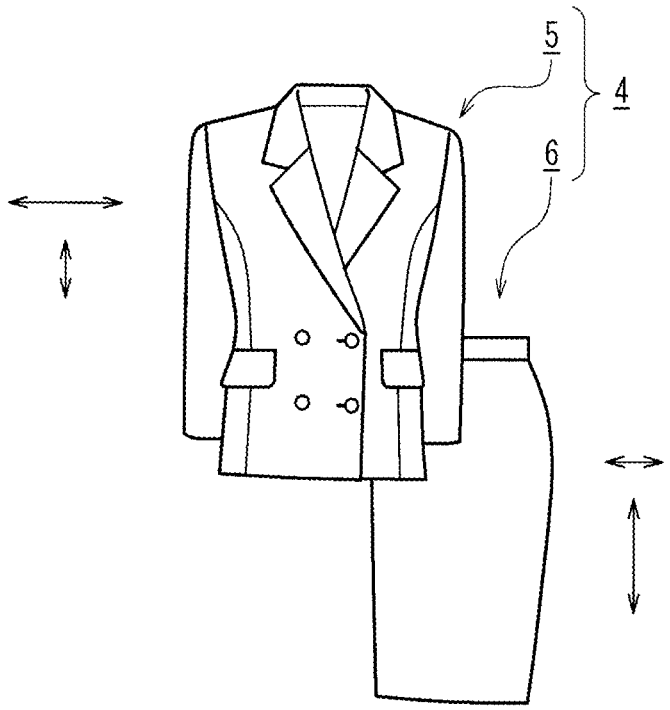
FIG. 2 is a front view of a lady's suit in another embodiment of the present invention.

FIG. 2 is a front view of a lady's suit in another example of the present invention. A lady's suit 4 is a two-piece suit composed of a coat 5 and a skirt 6, which are made from the same fiber material and the same woven fabric structure, and have the same colored pattern. The coat 5 stretches more in the weft direction than in the warp direction, and the skirt 6 stretches more in the warp direction than in the weft direction. The arrows indicate the stretchability in the warp and weft directions.

Figure 3:
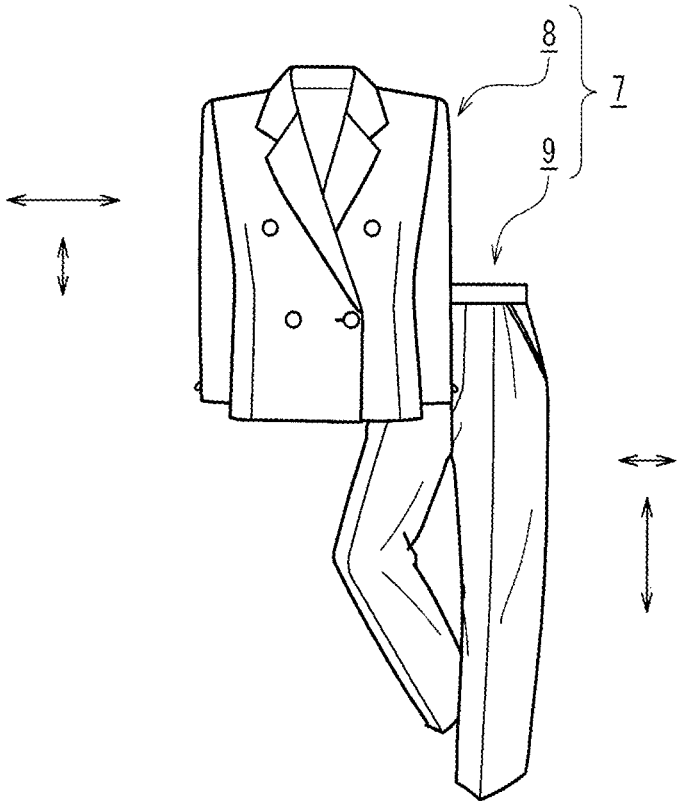
FIG. 3 is a front view of a lady's suit in still another embodiment of the present invention.

FIG. 3 is a front view of a lady's suit in still another example of the present invention. A lady's suit 7 is a two-piece suit composed of a coat 8 and trousers 9, which are made from the same fiber material and the same woven fabric structure, and have the same colored pattern. The coat 8 stretches more in the weft direction than in the warp direction, and the trousers 9 stretch more in the warp direction than in the weft direction. The arrows indicate the stretchability in the warp and weft directions.

EXAMPLES

The present invention will be explained more specifically by way of examples, though the present invention is not limited to the following examples.

<Stretchability>

The stretchabilities (EM1 and EM2) in the longitudinal and transverse directions in the KES testing were measured. Specifically, a tensile shear tester (KES-FB1AUTO manufactured by KATO TECH Co., Ltd.) was used to evaluate the stretchability from a maximum stretch rate at the time of applying loads up to 500 g (maximum load) at a constant strain rate of $4\times10^{-3}$/sec, i.e., a maximum stretch rate under a maximum load of 500 gf/cm.

Example 1

(1) Woven Fabric Cloth

100% Australian merino wool was used and subjected to cotton dyeing. A two-fold yarn (metric count: 72) was used as a warp yarn and a weft yarn to obtain a 2/2 twill woven fabric having a weight per unit area of 190 g/m$^2$. Thus, a woven fabric was prepared.
was prepared.

(2) Reduction Treatment

The reduction treatment was performed at 65° C. for 40 minutes at a bath ratio of 1:20 using a piece-dyeing machine, with the following recipe.

Reduction Treatment Recipe

Sodium sulfite (reductant): 10% owf

TEXPORT SN-10 (penetrant manufactured by NICCA CHEMICAL Co., Ltd.): 0.1 g/L

(3) Final Finish Step

Woven fabric for coat: the tentering processing was performed using a tenter drier under the conditions below.

Width: the drier was set to reduce the fabric width by −2% from the fabric width before being supplied to the drier.

Overfeed rate: 0%

Temperature: 120° C.

Time: 4 minutes

Woven fabric for trousers: the tentering processing was performed using a tenter drier under the conditions below.

Width: the drier was set to increase the fabric width by +13% from the fabric width before being supplied to the drier.

Overfeed rate: 30%

Temperature: 120° C.

Time: 6 minutes

Comparative Example 1

The same woven fabric as in Example 1 was used. The reduction treatment was not performed. The tentering processing was performed using a tenter drier under the conditions below. In Comparison Example 1, there was no difference in the stretchability of the coat and trousers.

Width: the drier was set to increase the fabric width by +2% from the fabric width before being supplied to the drier.

Overfeed rate: 10%

Temperature: 120° C.

Time: 5 minutes

Evaluation of woven fabric cloth: Table 1 below shows the stretchabilities E1 and E2 of the obtained man's woven fabric cloths in the KES testing.

TABLE 1

| | Stretchability of each part(%) | | | |
|---|---|---|---|---|
| | Coat | | Trousers | |
| | Weft direction JX(EM2) | Warp direction JY(EM1) | Weft direction PX(EM2) | Warp direction PY(EM1) |
| Ex. 1 | 13.2 | 5.1 | 4.4 | 11.0 |
| Comp. Ex. 1 | 8.2 | 4.1 | 8.2 | 4.1 |

Evaluation of suit: the above-described woven fabric cloths were each cut, sewn, and tailored into the two-piece suit exemplified in FIG. 1. In wearing tests, ten subjects wore these tailored suits, and answered two questionnaires, "which one provides higher mobility" and "in which one do you feel more pressure". Table 2 shows the results.

TABLE 2

| | Body part (%)* | | | | Questionnaire | |
|---|---|---|---|---|---|---|
| Subject No. | Back region | Arm region | Knee region | Hip | Which one provides higher mobility? | In which one do you feel more pressure? |
| 1 | 129 | 336 | 100 | 333 | Ex. 1 | Ex. 1 |
| 2 | 133 | 173 | 100 | 154 | Ex. 1 | No difference |
| 3 | 101 | 107 | 530 | 34 | Ex. 1 | Comp. Ex. 1 |
| 4 | 146 | 100 | 50 | 180 | Ex. 1 | No difference |
| 5 | 103 | 101 | 125 | 62 | Ex. 1 | No difference |
| 6 | 109 | 116 | 167 | 142 | Ex. 1 | No difference |
| 7 | 238 | 95 | 18 | 105 | No difference | No difference |
| 8 | 117 | 138 | 120 | 160 | Ex. 1 | No difference |
| 9 | 105 | 155 | 200 | 125 | Ex. 1 | Ex. 1 |
| 10 | 201 | 121 | 180 | 175 | Ex. 1 | Ex. 1 |
| Average | 138 | 144 | 159 | 147 | — | — |

(Note) The values (%) of the respective body parts are dimensional change ratios (Example 1/Comparative Example 1) in the posture of crossing arms (back region), holding a strap (arm region), and squatting (knee region and hip), relative to the dimensions of the back region, arm region, knee region, and hip when the wearer stood erect. The ratio larger than 100% means that the stretchability of Example 1 is high and follows the movement of the wearer.

From the results above, it was confirmed that the coat of Example 1 of the present invention has high stretchability in the weft direction and the trousers thereof have high stretchability in the warp direction, and hence they have stretchability that follows the movement of a human body and provide high mobility.

Example 2

The same woven fabric for coat as in Example 1 was used. The woven fabric for trousers was prepared in the same manner as in Example 1, except that the dryer's setting value for the fabric width from the fabric width before being supplied to the dryer and the overfeed rate in the final finish step (tentering processing) were changed as below. Table 3 summarizes the conditions and results.

Woven fabric for trousers: the tentering processing was performed using a tenter drier under the conditions below.

Width: the drier was set to increase the fabric width by +10% from the fabric width before being supplied to the drier.

Overfeed rate: 25%

Temperature: 120° C.

Time: 6 minutes

Example 3

The same woven fabric for coat as in Example 1 was used. The woven fabric for trousers was prepared in the same manner as in Example 1, except that the dryer's setting value for the fabric width from the fabric width before being supplied to the dryer and the overfeed rate in the final finish step (tentering processing) were changed as below. Table 3 summarizes the conditions and results.

Woven fabric for trousers: the tentering processing was performed using a tenter drier under the conditions below.

Width: the drier was set to increase the fabric width by +15% from the fabric width before being supplied to the drier.

Overfeed rate: 30%

Temperature: 120° C.

Time: 7 minutes

Example 4

The same woven fabric for trousers as in Example 1 was used. The woven fabric for coat was prepared in the same manner as in Example 1, except that the dryer's setting value for the fabric width from the fabric width before being supplied to the dryer and the overfeed rate in the final finish step (tentering processing) were changed as below. Table 3 summarizes the conditions and results.

Woven fabric for coat: the tentering processing was performed using a tenter drier under the conditions below.

Width: the drier was set to increase the fabric width by 0% from the fabric width before being supplied to the drier.

Overfeed rate: 10%

Temperature: 120° C.

Time: 5 minutes

Example 5

The same woven fabric for trousers as in Example 1 was used. The woven fabric for coat was prepared in the same manner as in Example 1, except that the dryer's setting value for the fabric width from the fabric width before being supplied to the dryer and the overfeed rate in the final finish step (tentering processing) were changed as below. Table 3 summarizes the conditions and results.

Woven fabric for coat: the tentering processing was performed using a tenter drier under the conditions below.

Width: the drier was set to decrease the fabric width by −5% from the fabric width before being supplied to the drier.

Overfeed rate: 0%

Temperature: 120° C.

Time: 4 minutes

TABLE 3

| | Stretchability of each part(%) | | | |
|---|---|---|---|---|
| | Coat | | Trousers | |
| | Weft direction JX(EM2) | Warp direction JY(EM1) | Weft direction PX(EM2) | Warp direction PY(EM1) |
| Ex. 2 | 13.2 | 5.1 | 5.0 | 8.2 |
| Ex. 3 | 13.2 | 5.1 | 3.8 | 13.5 |
| Ex. 4 | 10.4 | 5.5 | 4.4 | 11.0 |
| Ex. 5 | 15.8 | 3.8 | 4.4 | 11.0 |

The woven fabric cloths thus obtained were each cut, sewn, and tailored into the two-piece suit exemplified in FIG. 1. Wearing tests were performed in the same manner as in Example 1 using the tailored suits. As a result, it was confirmed that the coats of the respective Examples of the present invention have high stretchability in the weft direction, and the trousers thereof have high stretchability in the warp direction, and hence they have stretchability that follows the movement of a human body, provide high mobility, and can be worn easily. Further, the cloths of Examples 1-5 were applied to the lady's jacket and skirt shown in FIG. 2. It was confirmed that, as in Examples of the suit composed of the coat and trousers, they have stretchability that follows the movement of a human body and can be worn easily.

DESCRIPTION OF REFERENCE NUMERALS

1 man's suit
2, 5, 8 coat
3, 9 trousers
4, 7 lady's suit
6 skirt

The invention claimed is:

1. A two-piece suit comprising a coat and trousers or a skirt that are made from a woven fabric containing animal hair fibers, wherein a stretchability of the fabric of the coat in a weft direction of the coat is larger than a stretchability of the fabric of the coat in a warp direction of the coat, a stretchability of the fabric of the trousers or the skirt in a warp direction of the trousers or the skirt is larger than a stretchability of the fabric of the trousers or the skirt in a weft direction of the trousers or the skirt, the weft direction is a waist width direction of the coat and the trousers or the skirt, and the warp direction is a body length direction of the coat and the trousers or the skirt.

2. The suit according to claim 1, wherein for a stretchability (JX) in the weft direction of the coat, a maximum stretch rate under a load of 500 gf/cm ranges from 10 to 16%, and for a stretchability (JY) in the warp direction thereof, a maximum stretch rate under a load of 500 gf/cm ranges from 2 to 8%.

3. The suit according to claim 1, wherein for a stretchability (PX) in the weft direction of the trousers or skirt, a maximum stretch rate under a load of 500 gf/cm ranges from 3 to 10%, for a stretchability (PY) in the warp direction thereof, a maximum stretch rate under a load of 500 gf/cm ranges from 8 to 14%, and the PX and the PY values of the trousers or skirt satisfy a relationship such that the PX is smaller than the PY.

4. The suit according to claim 1, wherein the woven fabric containing animal hair fibers contains 70 mass % or more of animal hair fibers and 30 mass % or less of other fibers.

5. The suit according to claim 1, wherein the woven fabric does not contain elastic synthetic fibers.

6. The suit according to claim 1, wherein the woven fabric constituting upper and lower parts of the suit is made from the same fiber material and has the same woven fabric structure, has the same color when patternless, and has the same pattern when colored patterned.

7. The suit according to claim 1, wherein the woven fabric constituting the coat and the trousers or the skirt is a dyed product selected from a cotton-dyeing product, a yarn-dyeing product, and a piece-dyeing product.

8. A method for producing a suit that is a two-piece suit comprising a coat and trousers or a skirt that are made from a woven fabric containing at least one selected from animal hair fibers and synthetic fibers, the coat stretching more in a weft direction than in a warp direction, and the trousers or skirt stretching more in the warp direction than in the weft direction, comprising:

for upper and lower parts of the suit, dyeing yarns of the same quality by the same method and producing woven fabrics that are woven in the same structure;

differentiating stretchability of the woven fabrics in warp and weft directions in tentering processing by a drier or tentering processing by a heat set in a final finish step, thereby producing a cloth for coat and a cloth for trousers and/or skirt, respectively;

cutting the cloth for coat and the cloth for trousers and/or skirt so that the coat stretches more in the weft direction than in the warp direction, and the trousers and/or skirt stretch more in the warp direction than in the weft direction; and sewing the cut cloths, thereby tailoring a suit.

9. The method for producing the suit according to claim 8, wherein the tentering processing is performed by a tenter.

10. The method for producing the suit according to claim 8, wherein the temperature of the tentering processing is 100° C. to 150° C., and the time is 1 to 10 minutes.

11. The method for producing the suit according to claim 8, wherein, when the suit is a woven fabric containing 70% or more of animal hair fibers, a reduction treatment is performed before the tentering processing, thereby obtaining a woven fabric stretchable both in longitudinal and transverse directions.

12. The method for producing the suit according to claim 8, wherein a stretchability (JX) in the weft direction of the coat ranges from 10 to 16%, and a stretchability (JY) in the warp direction thereof ranges from 2 to 8%.

13. The method for producing the suit according to claim 8, wherein a stretchability (PX) in the weft direction of the trousers or skirt ranges from 3 to 10%, a stretchability (PY) in the warp direction thereof ranges from 8 to 14%, and PX<PY is satisfied.

14. The method for producing the suit according to claim 8, wherein the woven fabric containing animal hair fibers contains 70 mass % or more of animal hair fibers and 30 mass % or less of other fibers.

15. The method for producing the suit according to claim 8, wherein the woven fabric does not contain elastic synthetic fibers.

16. The method for producing the suit according to claim 8, wherein each of the stretchabilities is measured from a maximum stretch rate under a maximum load of 500 gf/cm.

17. The method for producing the suit according to claim 8, wherein the woven fabric constituting upper and lower parts of the suit is made from the same fiber material and has the same woven fabric structure, has the same color when patternless, and has the same pattern when colored patterned.

18. The method for producing the suit according to claim 8, wherein the woven fabric constituting upper and lower parts of the suit is a dyed product selected from a cotton-dyeing product, a yarn-dyeing product, and a piece-dyeing product.

* * * * *